US008408991B2

(12) United States Patent
Gilmore

(10) Patent No.: US 8,408,991 B2
(45) Date of Patent: Apr. 2, 2013

(54) GAMING SYSTEM AND METHOD OF PROVIDING AN ELECTRONIC GAME

(75) Inventor: Jason Gilmore, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/565,513

(22) Filed: Aug. 2, 2012

(65) Prior Publication Data

US 2013/0059642 A1 Mar. 7, 2013

(30) Foreign Application Priority Data

Sep. 5, 2011 (AU) ..... 2011218762

(51) Int. Cl.
*A63F 9/24* (2006.01)

(52) U.S. Cl. ..... 463/20; 463/16; 463/25; 463/26; 463/29

(58) Field of Classification Search ..... 463/16, 463/20, 25, 26, 29
See application file for complete search history.

(56) References Cited

U.S. PATENT DOCUMENTS 8,123,610 B2 * 2/2012 Hornik ..... 463/20
2005/0148383 A1 7/2005 Mayeroff
2009/0111560 A1 4/2009 Davis et al.
2009/0325670 A1 * 12/2009 Kelly et al. ..... 463/20

FOREIGN PATENT DOCUMENTS

WO 2008/055321 A1 5/2008

OTHER PUBLICATIONS

Examiner's First Report for AU Pat. Appln. No. 2011218762 (dated Nov. 11, 2011).

* cited by examiner

*Primary Examiner* — Omkar Deodhar
(74) *Attorney, Agent, or Firm* — Howard & Howard Attorneys PLLC

(57) ABSTRACT

A gaming system and a method provide primary and secondary games to players using a plurality of linked gaming machines. Each gaming machine includes a display. For each gaming machine, an associated player is allowed to make a wager on a primary game, an outcome of the primary game is randomly selected, and if the outcome of the primary game is a winning outcome, awarding the associated player a primary award as a function of the outcome, the wager made by the player, and a predetermined paytable. If a triggering conditioning occurred in one of the primary games and a secondary game is initiated. The secondary game is a video slot game including a plurality of video reels. Each video reel is displayed on a respective display of one of the gaming machines.

24 Claims, 13 Drawing Sheets

80

| SPINS PER MINUTE | BONUS MULTIPLIER | SPINS PER MINUTE | BONUS MULTIPLIER |
|---|---|---|---|
| 1 | 1x | 13 | 10x |
| 5 | 2x | 15 | 12x |
| 7 | 3x | 17 | 14x |
| 9 | 4x | 18 | 16x |
| 11 | 5x | 19 | 18x |

FIG. 4B

82A

| TIME | 10 | 20 | 30 | 40 | 50 | 60 | 70 | 80 | 90 | 100 | 110 | 120 | 130 | MULTIPLIER |
|---|---|---|---|---|---|---|---|---|---|---|---|---|---|---|
| PLAYER A | X | X | X | X | X | X | X | X | X | X | T | | | 6x |
| PLAYER B | X | X | X | X | X | X | | | X | X | | | | 4x |
| PLAYER C | | | X | | | X | | | | X | | | | 2x |
| PLAYER D | X | X | | | X | X | | | X | X | | | | 4x |

FIG. 4C

82B

| TIME | 10 | 20 | 30 | 40 | 50 | 60 | 70 | 80 | 90 | 100 | 110 | 120 | 130 | MULTIPLIER |
|---|---|---|---|---|---|---|---|---|---|---|---|---|---|---|
| PLAYER A | X | X | X | X | X | X | X | X | X | X | | X | T | 6x |
| PLAYER B | X | X | X | X | X | X | X | | X | X | | X | | 3x |
| PLAYER C | | | X | | | X | | | | X | | | | 1x |
| PLAYER D | X | X | | | X | X | | | B | | | | | 1x |

FIG. 4D

82C

| TIME | 10 | 20 | 30 | 40 | 50 | 60 | 70 | 80 | 90 | 100 | 110 | 120 | 130 | MULTIPLIER |
|---|---|---|---|---|---|---|---|---|---|---|---|---|---|---|
| PLAYER A | X | X | X | X | X | X | X | X | X | X | X | X | T | 12x |
| PLAYER B | X | X | X | X | X | X | X | | X | X | | X | | 4x |
| PLAYER C | B | | X | | | | | | | | | | | 1x |
| PLAYER D | X | X | | | X | X | | | | X | X | X | | 3x |

FIG. 4E

82D

| TIME | 10 | 20 | 30 | 40 | 50 | 60 | 70 | 80 | 90 | 100 | 110 | 120 | 130 | MULTIPLIER |
|---|---|---|---|---|---|---|---|---|---|---|---|---|---|---|
| PLAYER A | X | X | X | X | X | X | X | X | X | X | X | X | T | 7x |
| PLAYER B | X | X | X | X | X | X | X | | X | X | | | | 2x |
| PLAYER C | B | | | | | | | | | | | | X | 1x |
| PLAYER D | X | X | | | X | X | | | | X | X | X | X | 4x |

FIG. 4F

| Symbol | Properties |
|---|---|
| | Progressive Trigger |
| | WILD (substitutes for the symbols below only) |
| A | Ace |
| K | King |
| Q | Queen |
| J | Jack |
| 10 | Ten |

FIG. 11

| Bonus Reel Symbol | Properties | Bonus Reel Symbol | Properties |
|---|---|---|---|
| | MAXI Progressive Jackpot Prize (Bonus Reel) | 3x PAY | Winning Line Pay x 3 (Does not apply to Progressives) |
| | MEGA Progressive Jackpot Prize (Bonus Reel) | 2x PAY | Winning Line Pay x 2 (Does not apply to Progressives) |
| | MAJOR Progressive Jackpot Prize (Bonus Reel) | +3 FREE GAMES | Adds 3 additional games to games remaining |
| | MINI Progressive Jackpot Prize (Bonus Reel) | +2 FREE GAMES | Adds 2 additional games to games remaining |
| 10x PAY | Winning Line Pay x 10 (Does not apply to Progressives) | +1 FREE GAMES | Adds 1 additional game to games remaining |
| 5x PAY | Winning Line Pay x 5 (Does not apply to Progressives) | | Blank |

FIG. 12

| Symbol Combination | Payout | Symbol Combination | Payout |
|---|---|---|---|
| 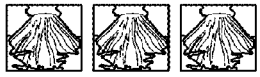 | Progressive | Q Q Q | 100 |
| 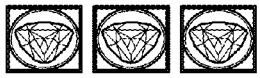 | 1000 | J J J | 50 |
| A A A | 200 | 10 10 10 | 10 |
| K K K | 150 | | |
FIG. 13
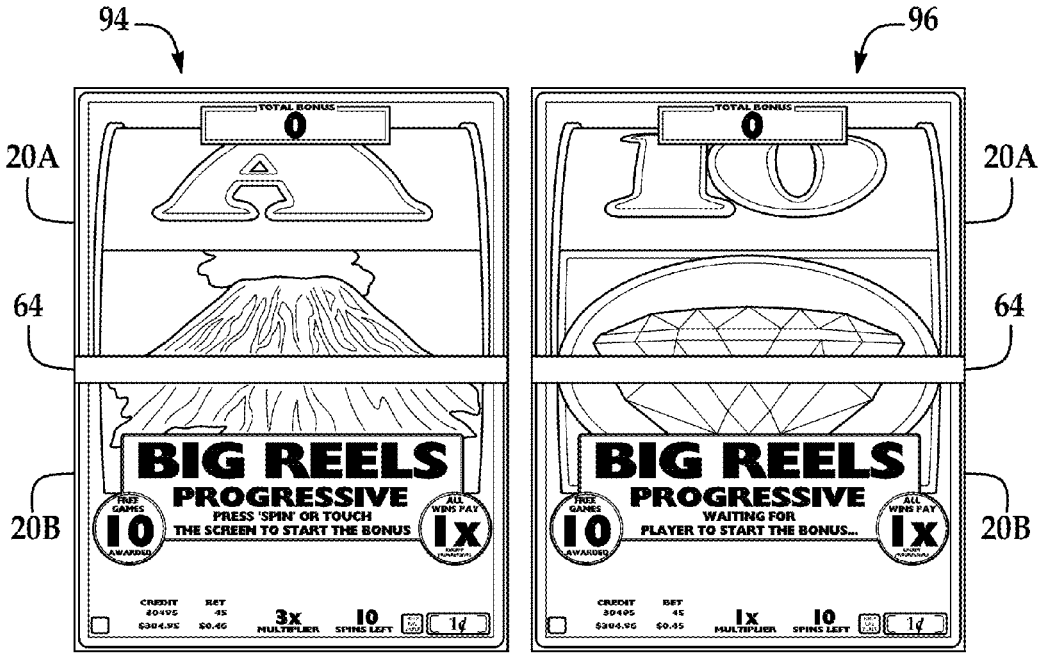
FIG. 14 FIG. 15

GAMING SYSTEM AND METHOD OF PROVIDING AN ELECTRONIC GAME

CROSS-REFERENCE TO RELATED APPLICATION

This application claims the benefit of Australian Patent Application No. 2011218762, filed on Sep. 5, 2011, the entire disclosure of which is incorporated by reference herein.

FIELD OF THE INVENTION

The present invention relates generally to video gaming machines and more particularly, to an apparatus and method for providing a bonus or secondary game across a plurality of gaming machines.

BACKGROUND OF THE INVENTION

Gaming machines, such as slot machines, are a cornerstone of the gaming industry. Generally, the popularity of such machines with players is dependent on the perceived likelihood of winning money at the particular game and the intrinsic entertainment value of the game relative to other available gaming options. Where the available gaming options include a number of competing games and the expectation of winning each game is believed to be generally the same, players are most likely to be attracted to the most entertaining and exciting games. Thus, gaming operators strive to employ the most entertaining and exciting games available because such games attract frequent play and, hence, increase profitability to the operator.

Furthermore, one concept that has been successfully employed to enhance the entertainment value of the game is the addition of a bonus game that may be played in conjunction with the "primary" game. The bonus game may comprise any type of game, either similar to or completely different from the primary game. The bonus game is initiated upon the occurrence of a selected event or outcome of the primary game.

Because the excitement and entertainment value of the primary game provides increased player appeal relative to other gaming machines and the bonus game concept increases player appeal and excitement, thereby increasing the chance to win the potential pay-out amount, there is a continuing need to develop new features for primary and bonus games. New features are necessary to appeal to player interest and enhance excitement in order to entice longer play and satisfy demands of operators for interesting games and increased profitability.

The present invention is directed to satisfying these needs.

SUMMARY OF THE INVENTION

In a first aspect of the present invention, a method provides primary and secondary games to players. The method includes the step of providing a plurality of linked gaming machines. Each gaming machine includes a display. For each gaming machine, an associated player is allowed to make a wager on a primary game, an outcome of the primary game is randomly selected, and if the outcome of the primary game is a winning outcome, awarding the associated player a primary award as a function of the outcome, the wager made by the player, and a predetermined paytable. The method further includes the steps of determining if a triggering conditioning occurred in one of the primary games and initiating a secondary game. The secondary game is a video slot game including a plurality of video reels displayed on the displays of the gaming machines.

In a second aspect of the present invention, a gaming system is provided. The gaming system includes a plurality of linked gaming machines and a jackpot controller. Each gaming machine includes a display and a game controller. The game controller allows an associated player to make a wager on a primary game, randomly selects an outcome of the primary game, determines if the outcome of the primary game is a winning outcome, and responsively awards the associated player a primary award as a function of the outcome, the wager made by the player, and a predetermined paytable. The jackpot controller determines if a triggering condition occurred in one of the primary games and initiates a secondary game. The secondary game is a video slot game which includes a plurality of video reels displayed on the displays of the gaming machines.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4B is a first table associated with the exemplary bonus game of FIG. 4A;

FIG. 4C is a second table associated with the exemplary bonus game of FIG. 4A;

FIG. 4D is a third table associated with the exemplary bonus game of FIG. 4A;

FIG. 4E is a fourth table associated with the exemplary bonus game of FIG. 4A;

FIG. 4F is a fifth table associated with the exemplary bonus game of FIG. 4A;

FIG. 11 is a chart of reel symbols used in a bonus event of the present invention, according to an embodiment of the present invention;

FIG. 12 is a chart of bonus reel symbols used in the bonus event of FIG. 11;

FIG. 13 is a sample paytable for the bonus event of FIG. 11;

FIG. 14 is a sample screen shot of a progressive display, according to an embodiment of the present invention;

FIG. 15 is a second sample screen shot of a progressive displaying, according to the embodiment of the present invention of FIG. 1;

DETAILED DESCRIPTION OF THE PREFERRED EMBODIMENT

With reference to the drawings and in operation, the present invention provides a gaming system 10 which provides a primary (or base) game and a secondary game to players.

Figure 2A:
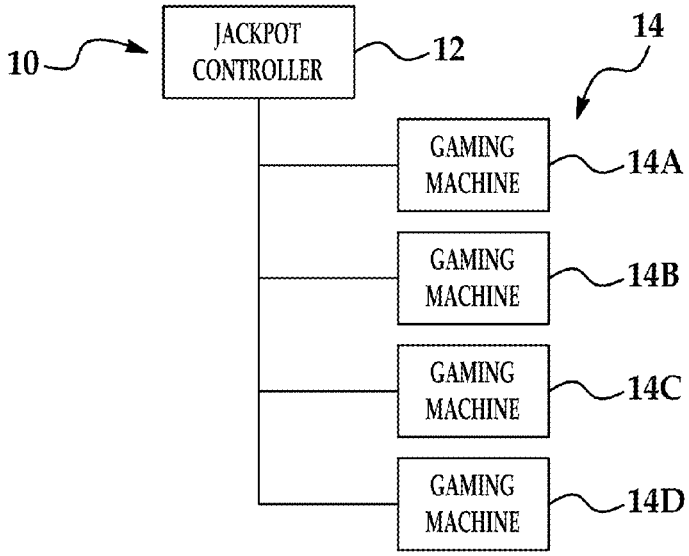
FIG. 2A is a diagram of a system for providing electronic games, according to an embodiment of the present invention.
Figure 2B:
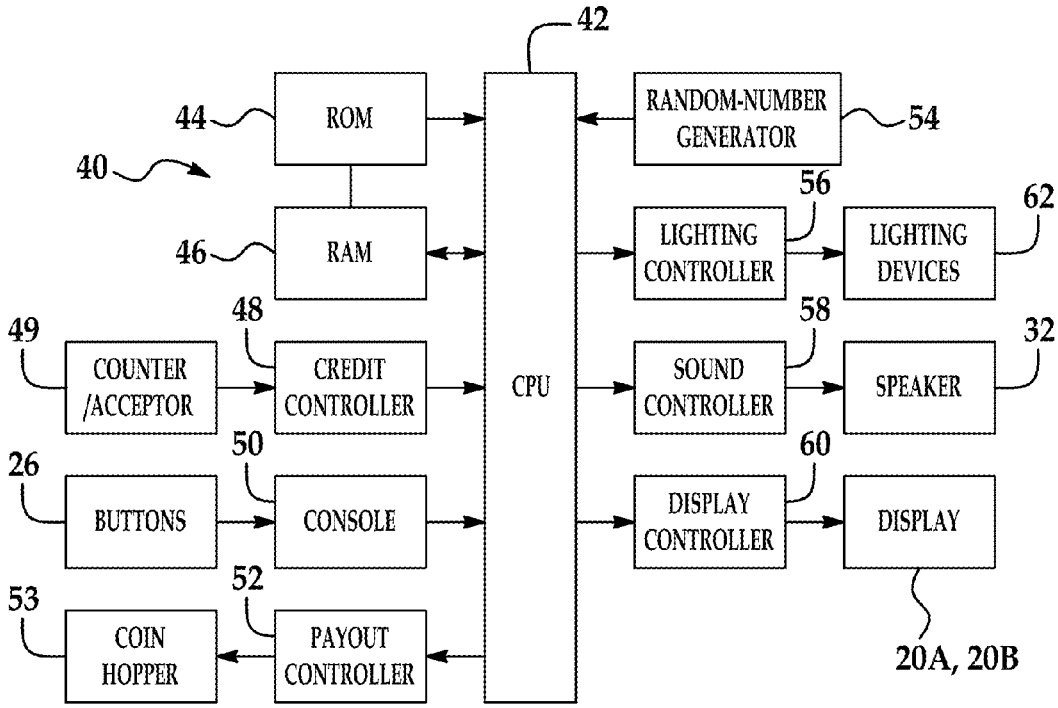
FIG. 2B is a schematic representation of the video gaming machine of the present invention; and, FIG. 3 is a diagrammatic illustration of the system of FIG. 2A, according to an embodiment of the present invention.
Figure 3:
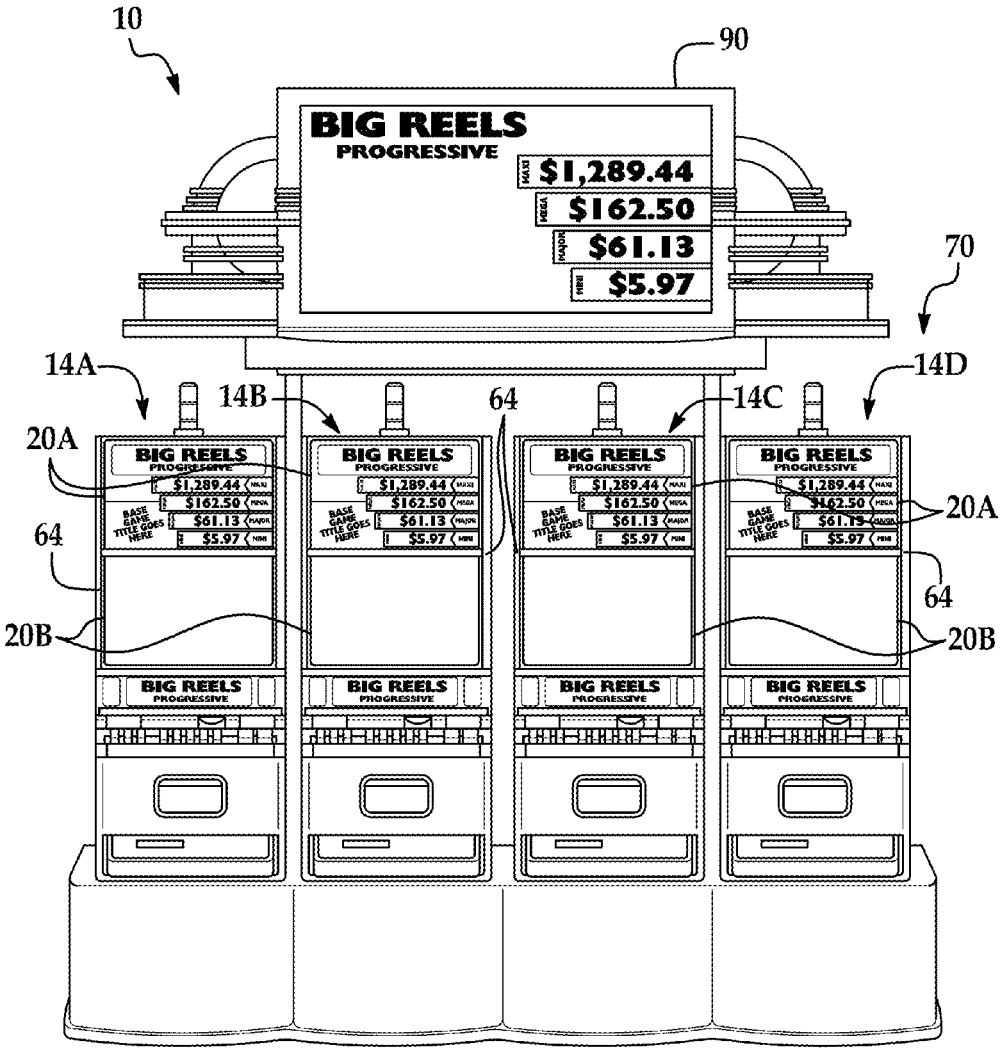

With specific reference to FIG. 2B, in one embodiment, the system 10 includes a jackpot controller 12 and a plurality of gaming machines 14. In the illustrated embodiment, the system 10 includes four gaming machines 14A, 14B, 14C, 14D, which in one embodiment as shown in FIG. 3 are arranged in a bank, i.e., are arranged together, adjacently. It should be noted, however, that the gaming machines 14 may include any number of gaming machines 14, and may be arranged in any manner, such as in a circle or along a curved arc. Furthermore, additional groups of gaming machines 14 may be coupled to the jackpot controller 12.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

A preferred embodiment of the present invention is a video gaming machine preferably installed in a casino.

Figure 1:
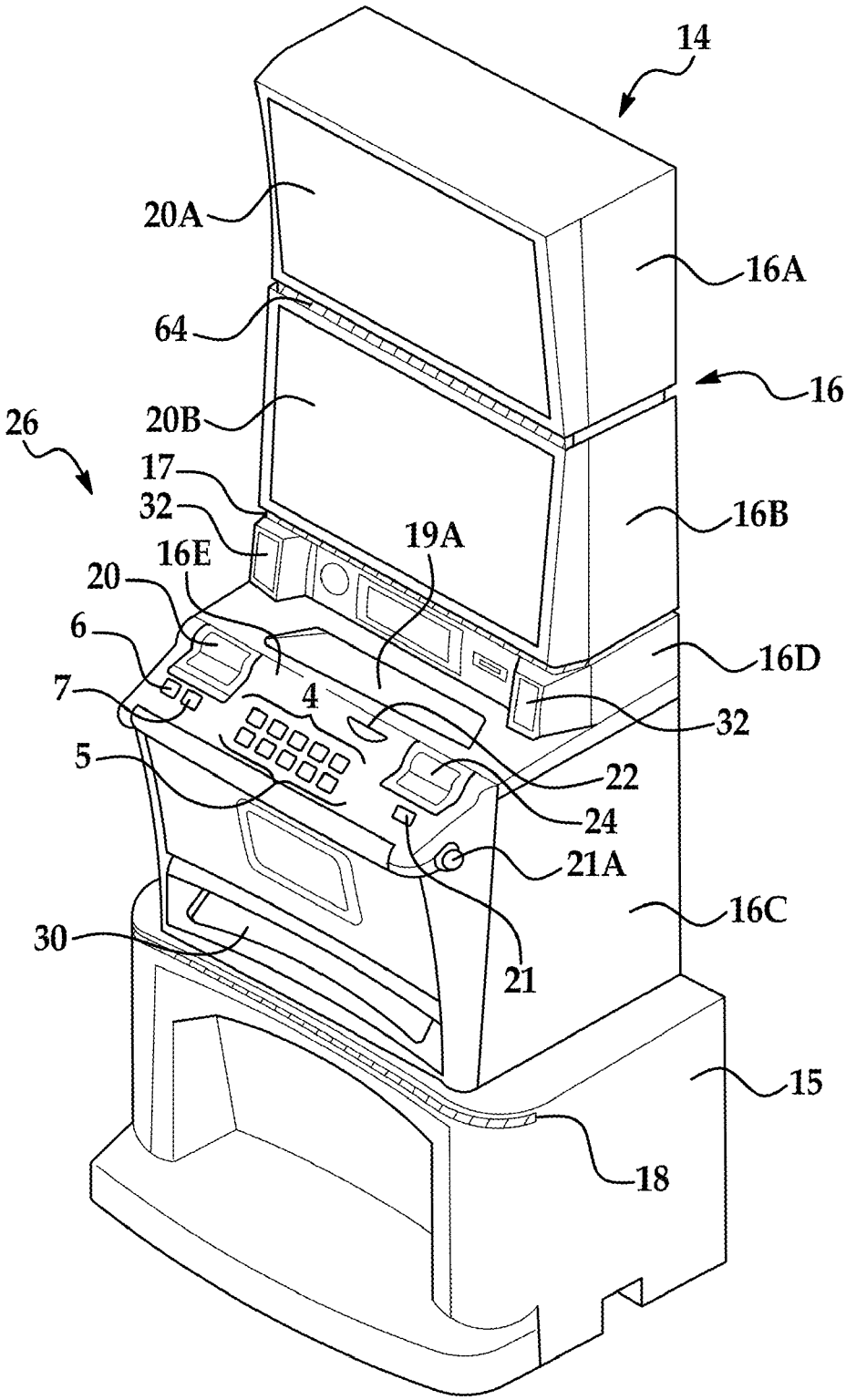
FIG. 1 is a perspective view of a gaming machine.

Referring to FIG. 1, in the illustrated embodiment, each gaming machine 14 comprises a box-shaped modular cabinet 16. One such cabinet is disclosed in commonly owned U.S. Patent Application Publication 20100087259 (Ser. No. 12/287,428), filed Oct. 8, 2008, which is hereby incorporated by reference.

Each gaming machine 14 has a modular structure for a video gaming machine of an embodiment of the present invention. The gaming machine 14 is configured by a first cabinet 16A including a display 20A; a second cabinet 16B including a second display 20B, a third cabinet 16C including input devices for playing the game and a fourth cabinet 16D including a controller for controlling each section of the gaming machine 14. The gaming machine 14 is generally set up on a game stand 15 depending on a situation where the gaming machine 14 is setup.

As shown in FIG. 1, a part of the top surface of the third cabinet 16C facing to the player is designed to be slanted downward so that the player can easily operate input buttons and input devices 26 for the games displayed on the first display 20A and/or the second display 20B. With respect to the input buttons 26, there are provided BET switches 4, selection switches 5, a MAXBET switch 6 a PAYOUT switch 7, start buttons 21 and 21A. With respect to the input devices, there are provided a coin slot 22 and a bill acceptor 24. The BET switches 4 include five switches from 1BET to 5BET. The selection switches 5 include five switches from 1 (one) select to 5 (five) selects of bet lines. A coin tray 30 is provided in the lower part of the third cabinet 16C. Further, there is provided an output device, for example, a printer 20 on a slanted surface 16E of the third cabinet 16C for outputting printed material pertaining to the game of the gaming machine 14.

The instruction for performing a primary game or a secondary game is normally displayed on the first display 20A. Indicia or symbols for use in the game, e.g., cards used by a card game, roulette used in a roulette game and reels used in a reel game, are displayed on the second display 20B.

The BET switches 4 are switches for inputting a bet on the game. The player can input a bet from 1BET to 5BET using the BET switches 4 one time for a game. A selection switch 5 is a switch for, for example, selecting a line on the reels and the card, which the player wants to set on the games.

The MAXBET switch 6 is a switch for inputting the maximum bet that a player can spend against one time of a game. The PAYOUT switch 7 is a switch for rewarding the amount of money to a player, which has been credited onto the gaming machine. The start buttons 21, 21A are buttons for starting game. The starting buttons 21, 21A may be arranged on the slanted surface 16E of the third cabinet 16C and sidewall of the third cabinet 16C so that the player can select the starting button for his or her preference in this embodiment. A coin slot 22 is a hole for a player to insert the coin to the gaming machine 14. A bill acceptor 24 is a input and output device to be used in order to feed a bill or a cash card into the gaming machine 14, or in order to repay the amount of money, which has been credited.

As is known in the art, the first and second displays 20A, 20B may be touchscreens to implement a portion of a user interface.

In one embodiment the displays 20A, 20B each include a flat panel display, such as an LCD, LED, plasma, or other suitable display.

In particular, the second display 20B displays a game screen, see for example, FIG. 3. The primary game is displayed on the game screen. The primary game may be any type of game, including, but not limited to a video slot game, a keno game, a blackjack game, a video poker game, or any type of game which allows a player to make a wager, plays a game, and potentially provides the player an award based on an outcome of the game and a paytable.

One or more speakers 32 are installed inside the cabinet 16, and generates voice announcements and sound effects during game play.

With specific reference to FIGS. 2A and 2B, in the illustrated embodiment, each gaming machine 14 is controlled by a game controller 40. In one embodiment, the game controller 40 is within the cabinet 14. Alternatively, the game controller 40 may be separated from the cabinet 16, and connected through a network to the components of the cabinet 16.

In one embodiment, the jackpot controller 12 may be implemented by one of the game controllers 40. In still another embodiment, a single controller (not shown) which may be located remotely or within one of the cabinets 16 may perform all of the functions of the game controllers 40 for each gaming machine and the jackpot controller 12.

In the illustrated embodiment, the game controller 40 includes a CPU 42, a ROM 44, a RAM 46, a credit controller 48, a console unit 50, a payout controller 52, a random-number generator 54, a lighting controller 56, a sound controller 58, and a display controller 60.

The CPU 42 executes various programs, and thereby controls other components of the game controller 40 according to instructions and data accepted by the console unit 48. The CPU 42 in particular executes a game program, and thereby conducts a game having normal and bonus modes. The ROM 44 stores programs and databases used by the CPU 42. The ROM 44 in particular stores image data for producing two game images and screens on the displays 20A, 20B. The RAM 46 temporarily stores variables, parameters, and the like that are used by the CPU 42.

The credit controller 48 manages the amount of player's credits, which is equivalent to the amount of coins and bills counted and validated by the counter/acceptor 49. The console unit 50 monitors the input buttons 26 and accepts various instructions and data that a player enters through the input buttons 26. The payout controller 52 changes player's credits to coins, bills, or other monetary data by using the coin tray 30 or the like.

The random-number generator (RNG) 54 generates and outputs random numbers to the CPU 42 preferably at the start of each round of game. The CPU 42 uses the random numbers to determine an outcome of the primary and secondary games.

For example, if the primary game is a video slot game, the CPU 42 uses the RNG 54 to randomly select an arrangement of symbols to be displayed on the video reels.

The CPU 42 generally uses the random numbers to play the primary and secondary games and to determine whether or not to provide an award to a player at random in the following manner. The CPU 42 retrieves the random numbers from a winning combination table stored in the ROM 44. The winning combination table represents relationship between combinations of random numbers and types of awards.

The lighting controller 56 controls one or more lighting devices 62. The lighting controller 56 thereby causes the lighting devices 62 to blink and/or change brightness and color in specific patterns in order to produces lighting effects. In one embodiment, the lighting devices 62 include light devices 17, 18 and a Podium payline light 64

The Podium payline light 64 which is, as shown in FIGS. 1 and 14-16, located between the first and second displays 20A, 20B. As discussed more fully below, in the secondary game, the first and second displays 20A, 20B, and the Podium payline light 64 is utilized as a large reel, the Podium payline light 64 serving as the payline.

The sound controller 58 controls the speakers 32 to output voice announcements and sound effects during game play.

The display controller 60 controls the displays 20A, 20B to display various images on screens preferably by using computer graphics and image data stored in the ROM 44. The display controller 60 in particular controls video reels in a game screen displayed on the second display 20B by using computer graphics and the image data.

The display controller 60 further controls video reels in different manners depending on whether a round of game is in a normal or bonus mode.

It should be noted that the above described gaming machine 14 is for exemplary purposes only. The present invention is not limited to any particular gaming machine 14 and/or game. The gaming machine 14 may also include other features. For example, the gaming machine 14 may include a player tracking device (not shown) which is connected to a player tracking system. The gaming machine 14 may also utilize a cashless wagering system (not shown), such as a ticket in ticket out (TITO) system (not shown) and may include a player tracking device (not shown).

The game controller 40 awards a regular payout in response to the outcome of the primary game.

The game controller 40 displays the primary game on the display 20A. In one embodiment, the primary game is a video slot game. However, it should be noted that the primary game could be any type of game upon which a player could make a wager.

For example, in the case where the primary game is a video slot game, the primary game includes a plurality of elements in a grid having a plurality of cells defined by rows and/or columns. During play of the video slot game, the game controller 40 randomly selects the game elements to be displayed in the second display device 20B. The selected game elements are selected from a set of possible game elements. The game controller 40 is adapted to determine an outcome of each of the game based on the displayed game elements, the paytable, a wager, and predetermined paylines.

Each video slot game is generally first played in a conventional manner. The player makes a wager, which may be based on a predetermined denomination and a selected number of paylines. The reels are spun and game symbols or elements are randomly chosen for each cell. If a predetermined pattern of elements are randomly chosen for each cell on a played payline, the player is awarded a payout based on the payline, the wager, and a predetermined paytable. Many variations to the above described general play of a video slot game fall within the scope of the present invention. Such video slot games are well-known in the art, and are therefore not further discussed.

After the outcome of the primary game is determined, a triggering condition may be detected. If the triggering condition is detected then the secondary game is initiated.

In one aspect of the present invention, the secondary game is a progressive game in which multiple players may be eligible in to win a, generally large, jackpot or payout. The jackpot or payout is generally funded from a pool which is added to through contributions from the wagers made by a plurality of players. The triggering condition for the progressive award may be the appearance of a triggering symbol within the primary game of one the gaming machines 14, or may be based on a separate random event. The triggering condition may be determined at the jackpot controller 12 or the game controller 40. The triggering condition for one embodiment of the progressive game is discussed more fully below.

Alternatively, the secondary game is a bonus game in which only the player who has triggered the secondary game may win and the secondary jackpot or bonus is funded from the associated gaming machine 14. With respect to the bonus game, a plurality of the gaming machines 14 may be used to display the bonus game so that all of the players may share in the excitement of the bonus game. In one embodiment, the triggering condition is winning outcome condition. For example, in FIG. 3, if the primary game has a winning condition, then the bonus award would be awarded in addition to the award for the winning condition of the primary game. Alternatively, the triggering condition could be a losing outcome.

With specific reference to FIGS. 2-3, in one embodiment, the gaming system 10 includes a plurality of linked gaming machines 14 and a jackpot controller 12. Each gaming machine 14 includes display 20 and a game controller 40. The controller 40 allows an associated player to make a wager on a primary game, randomly selects an outcome of the primary game and determines if the outcome of the primary game is a winning outcome. If the outcome of the primary game is a winning outcome, the controller 40 awards the associated player a primary award as a function of the outcome, the wager made by the player, and a predetermined paytable.

Figure 16:
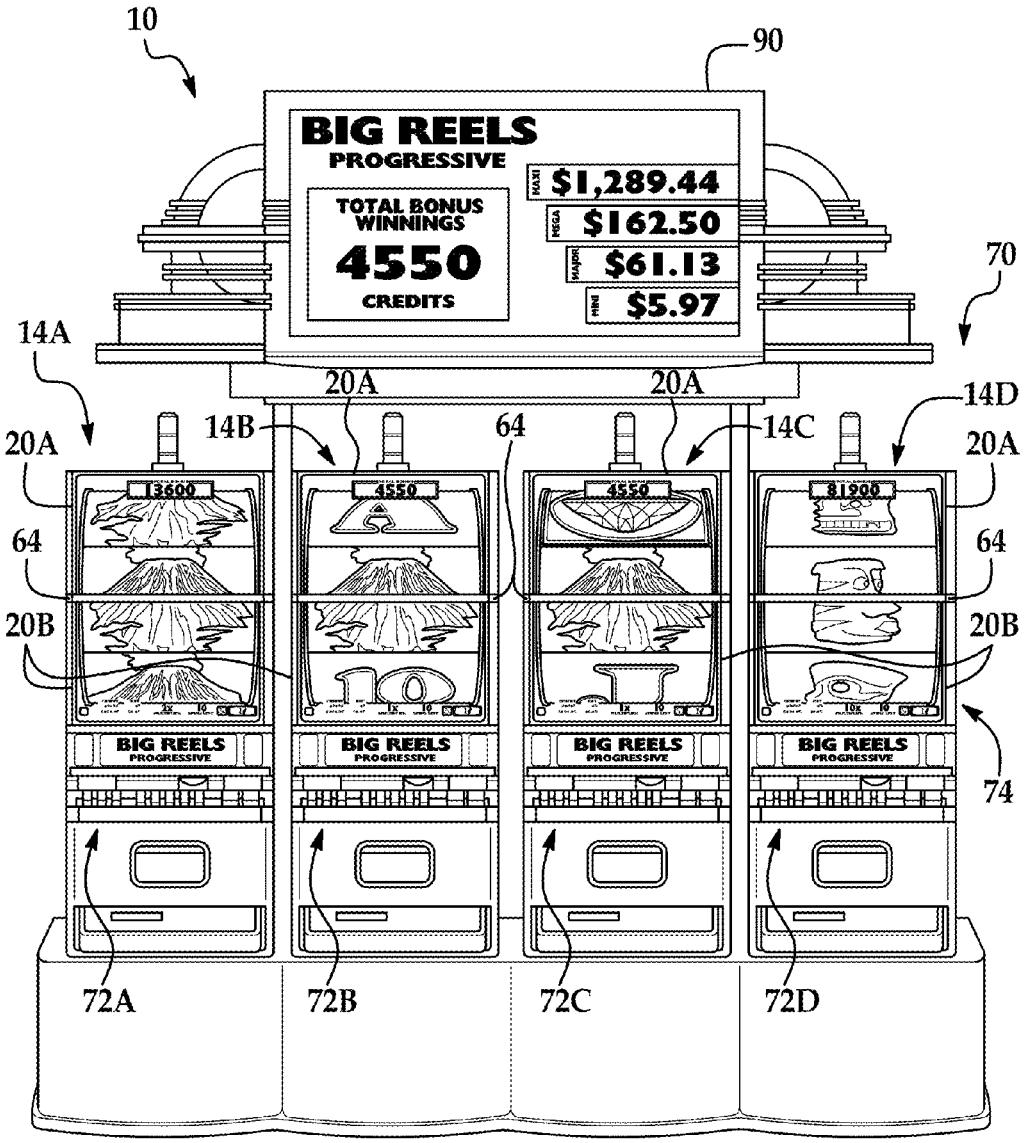
FIG. 16 is a view of a system for providing a progressive game, according to an embodiment of the present invention; and, FIG. 17 is a view of a system for providing a progressive game, according to another embodiment of the present invention.

The jackpot controller 12 determines if a triggering conditioning occurred in one of the primary games and initiates a secondary game 70 (see FIG. 16). The secondary game 70 is a video slot game including a plurality of video reels 72.

The video reels 72 form a grid. In one embodiment, each video reel 72 is a vertical reel and is displayed on a respective display 20 of one of the gaming machines 14.

Figure 17:
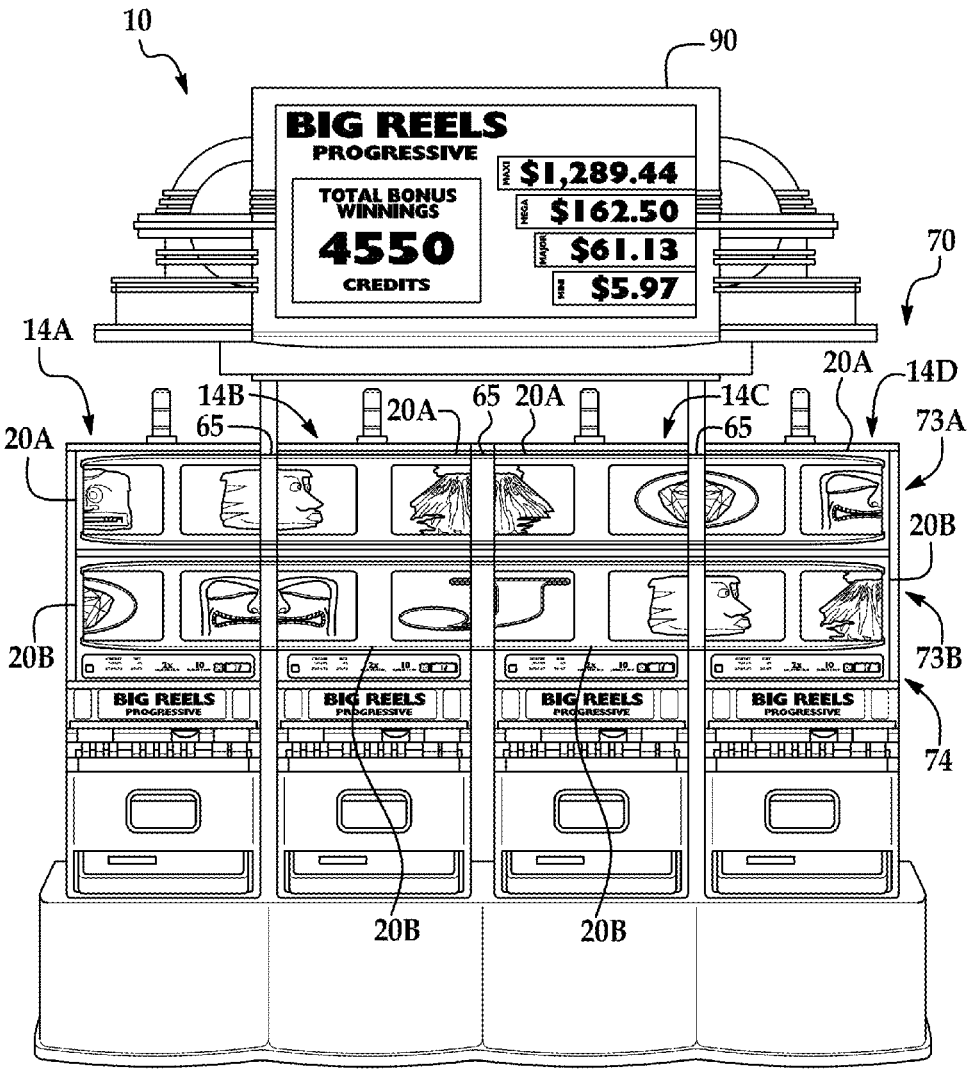

With reference to FIG. 17, in a second embodiment, the video reels 72 are horizontal reels 73A, 73B formed by a respective row of the grid. Vertical Podium payline lights 65 may be used to represent paylines for the horizontal video reels 73A, 73B.

The jackpot controller 12 randomly selects an outcome of the secondary game, spins the video reels 72 and displays a portion of the outcome of the secondary game 70 on each video reel each video reels 72, and awards one or more of the players a secondary award as a function of the outcome of the secondary game 70.

As discussed more fully below, in one embodiment the secondary game 70 is a progressive game. The secondary award may be either a set amount or a progressive award or amount. In one embodiment the progressive award may be one of a plurality of progressive award levels.

In the illustrated embodiment, the display 20 on each gaming machine 14 includes a first display 20A and a second display 20B. Generally, the primary game is displayed on the second display 20B and the secondary game, each reel 72 thereof uses both the first and second displays 20A, 20B. In this embodiment, a first portion of each video reel is displayed on the first display device 20A of the associated gaming machine and a second portion of each video reel being displayed on the second display device of the associated gaming machine.

In one embodiment, the reels 72 are arranged in a grid which defines a secondary video slot game. The secondary video slot game has one or more paylines. A winning outcome of the secondary video slot game may be defined as a predetermined arrangement of symbols appearing on one or more of the paylines. Although the illustrated embodiment includes four gaming machines 14, any number of gaming machines may be used. The gaming machines 14 may thus define, e.g., define a 3×3, 3×4, 3×5, 3×7, or any size grid.

In another embodiment, the last reel 72 may be used as a bonus reel while the other reels define a grid (see below) of a video slot game. The bonus reel may be used to modify the outcome of the video slot game.

With particular reference to FIG. 16, in the illustrated embodiment, the video slot game of the secondary game has a single payline 74 which is represented by the space between the first and second displays 20A, 20B and/or the light bar 64 of all of the gaming machines 14.

As shown in FIG. 16, in one embodiment, the plurality of gaming machines 14 are located side by side in a bank of gaming machines.

INDUSTRIAL APPLICABILITY

With reference to the drawings and in operation, the present invention provides a gaming system 10 and method for providing primary and secondary games. In one embodiment, the secondary game is a 4-level mystery link progressive (the Big Reels Progressive) where a bank of four gaming machines 14 participate in a common bonus event to win jackpot prizes and bonus credits. The top and bottom displays, i.e., the first and second displays 20A, 20B on each gaming machine 14 are used to construct a real time 3D 1×3+bonus reel video slot machine which spins during the bonus event. When the system 10 is in the Big Reels Progressive bonus event, the gaming machines 14 will resemble a giant 3+1 reel slot machine with a brilliantly lit payline.

In the illustrated embodiment, the Big Reels Progressive bonus event can be utilized with any dual screen video product. When a primary or base game is in a secondary bonus event, play is suspended when the Big Reels Progressive bonus event is triggered. When the Big Reels Progressive bonus event ends, normal game play resumes.

In one embodiment, there are four Jackpot Levels each with a different reset point. For example, the four jackpot levels may be as follows:

MAXI $1000
MEGA $100
MAJOR $10
MINI $1

Participation on this bank of gaming machines 14, and consequently, in the bonus event requires the use of an extra bet. This is primarily due to presentation implementations. A forced extra bet is required because any occupied machine on the gaming machines 14 will have to participate in the bonus event since it occupies both the top and bottom displays of the cabinets 16.

The benefit of forcing the extra bet (from the player's perspective) is in the form of a qualification multiplier that is applied to all Big Reels Progressive bonus event credit wins. The qualification multiplier is based on the player's speed of play; quicker play results in a higher multiplier.

With reference to FIG. 4B, the table 80 below shows the qualification multiplier that will be applied to all Big Reels Progressive bonus event wins. The table 80 is laid out showing the player's base game spins per minute and the resulting qualification multiplier. The values in this chart can be modified as needed. Players that play faster are rewarded with a higher multiplier.

The determination of spins per minute is a rolling average beginning with initiation of the first play of the first game and the previous sixty seconds of game play. The qualifying multiplier is shown to the player at the top of the game screen on the bottom LCD, and is updated in real-time.

With reference to FIGS. 4C-4F, several examples illustrating how the qualifying multiplier is awarded are shown. For the charts 82A, 82B, 82C, 82D, each "X" denotes when the play or spin button was pressed, the time length is a running clock in seconds, the bonus multiplier is a 1:1 ratio of the bet. (i.e., different from the chart in FIG. 4B), the "T" denotes when the Big Reels Progressive bonus event is triggered, and the "B" denotes when a primary game bonus is triggered:

The first table 82A illustrates a first example. When a bonus is triggered, the controller will look back over the last sixty seconds of play of each player to determine the qualifying multiplier.

The second table 82B illustrates a second example. Over the previous sixty seconds, one player is in a primary game bonus. Their bonus play is suspended when the community bonus event is initiated.

The third table 82C illustrates a third example. Over the previous one hundred twenty seconds, one player is in a primary game bonus. Their bonus play is suspended when the community bonus event is initiated. The jackpot controller 12 will look back in the play history as long as needed to determine each player's multiplier (i.e., the multiplier is based on a rolling average).

For optimal implementation, this system 10 uses a jackpot controller 12. The jackpot controller 12 is connected to all four gaming machines 14 in the game bank to provide communication to and communication from each gaming machine 14 in the system 10.

The jackpot controller 12 keeps track of information provided by each gaming machine 14, including when a bet was made and the value of the bet.

In turn, the jackpot controller 12 provides the following information to each gaming machine 14 including (1) advancement of the volcano animation in the top box displays, i.e., the first display 20A and a bank display 90, and (2) incrementing of the progressive displays on the plasma display 90 and top box displays 20A.

The jackpot controller 12 determines the game cycle (via a random number) value to determine when the bonus will be triggered. The jackpot controller 12 repeatedly sends out a Status Message to each gaming machine 14 to determine game play status and to receive the data described above.

Figure 4A:
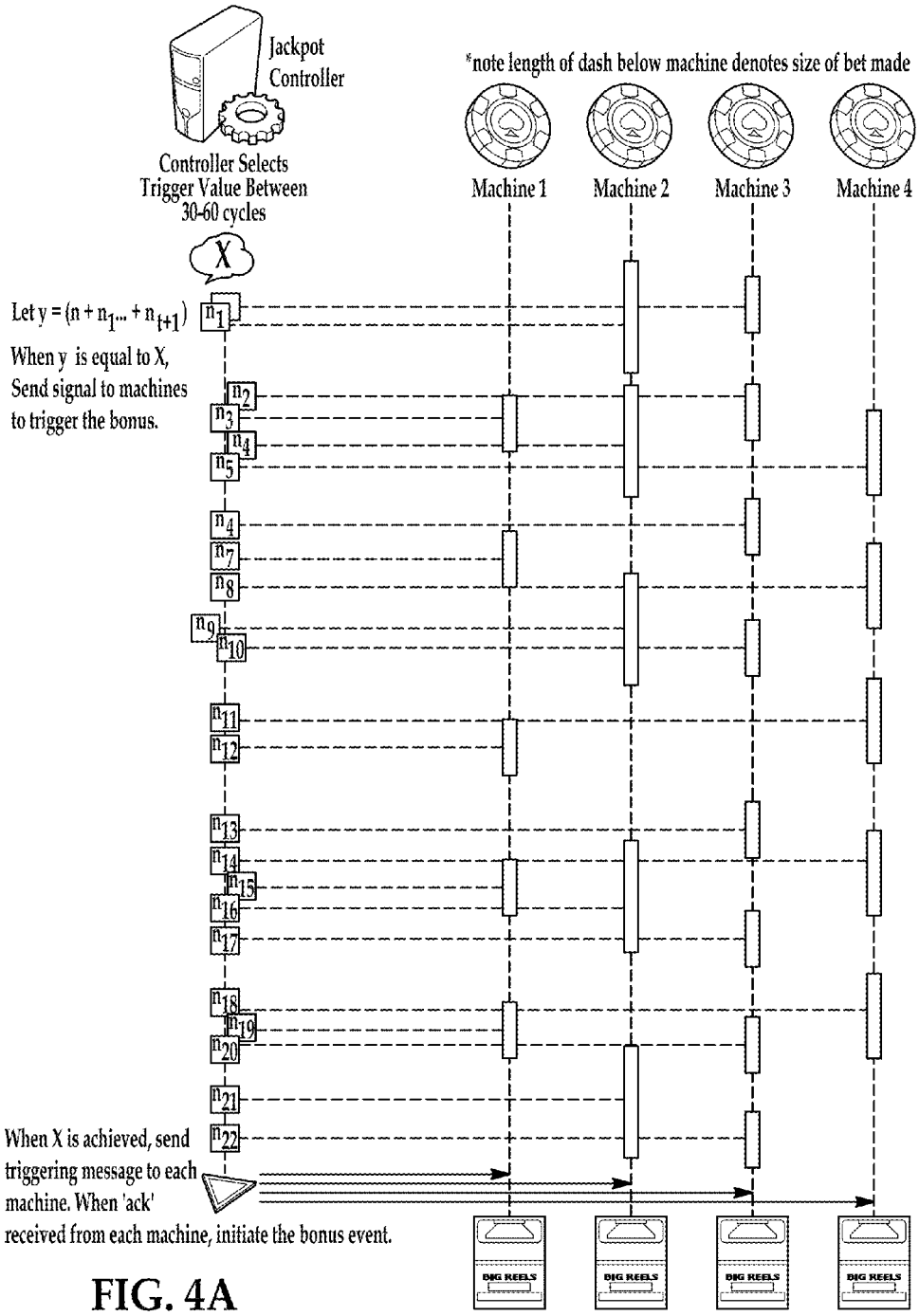
FIG. 4A is a flow diagram of a trigger process associated with an exemplary bonus game, according to an embodiment of the present invention.

Once trigger criteria has been met, the jackpot controller 12, sends a Bonus Event Trigger to each gaming machine 14 informing them the bonus has been initiated. One of the gaming machines 14 is designated by the jackpot controller 12 to be the master gaming machine 14. The master gaming machine 14 will, before each spin of the progressive game, send a Request Game Start message to the jackpot controller 12 to receive the random number and game data needed for each free spin. The jackpot controller 12 will then send the random number information to the master gaming machine 14 and the other gaming machines 14 via a Game Start message. FIG. 4A shows a sequence diagram for the Big Reels Progressive design using a jackpot controller 12.

During the bonus, the jackpot controller 12 will update the first display accordingly for each spin outcome.

Figure 5:
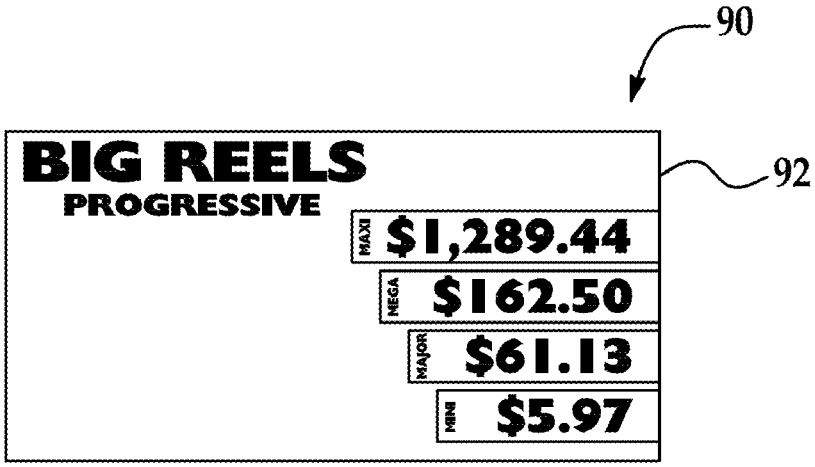
FIG. 5 is a first screen shot of a bank display, according to an embodiment of the present invention.

With reference to FIG. 5, a progressive screen 92 is displayed on the bank display 90. In the illustrated embodiment, the bank display 90 is located on top of the bank of gaming machines 14 (see FIGS. 3 and 16). The progressive screen 92 shows the current values of the progressive prizes. When the bonus is triggered, an animation and audio, i.e., "fanfare", will be displayed in the bank display 90 to let players know that the bonus event has been triggered.

Figure 6:
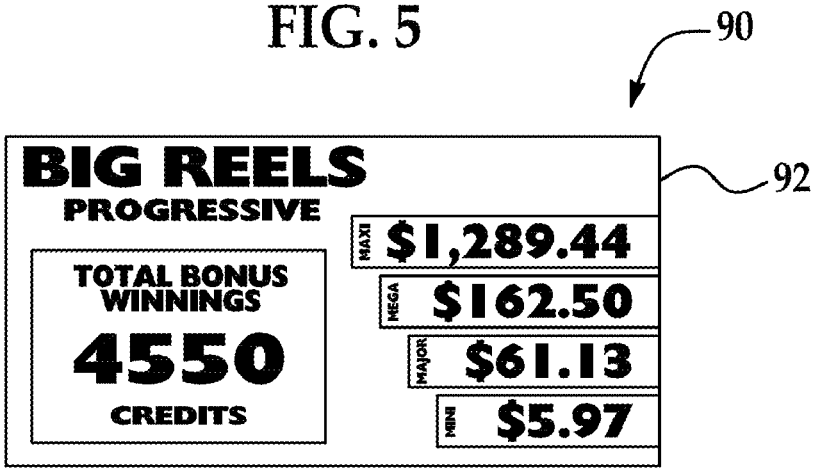
FIG. 6 is a second screen shot of a bank display, according to an embodiment of the present invention.

Optionally, the results of the reel spins or a tally of the total bonus amount awarded in the Big Reels Progressive bonus event is displayed on the display 90 (see FIG. 6).

Figure 7:
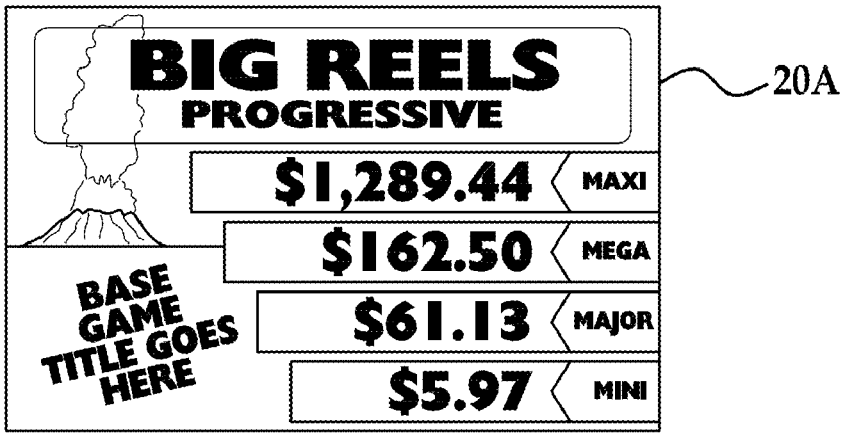
FIG. 7 is a first screen shot of a top display on the gaming machine, according to an embodiment of the present invention.

With reference to FIG. 7, during normal base game play, the first display 20A may also display the Big Reels Progressive prize display. The display 20A is laid out in such a way that the primary focus of the first display 20A is the Big Reels Progressive product line. An area to the lower left of the first display is reserved for the title of the primary game.

Figure 8A:
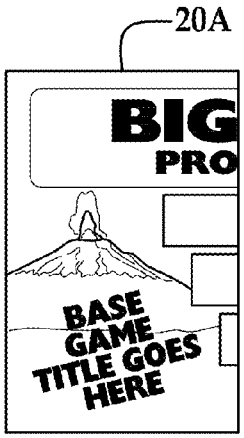
FIG. 8A is a first instance of a first screen shot of a top display on the gaming machine, according to an embodiment of the present invention.
Figure 8B:
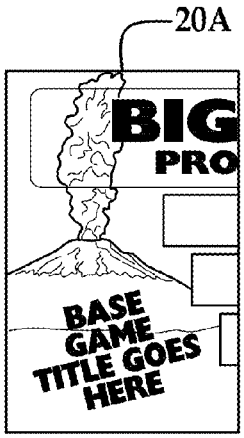
FIG. 8B is a second instance of the first screen shot of a top display on the gaming machine, according to an embodiment of the present invention.
Figure 8C:
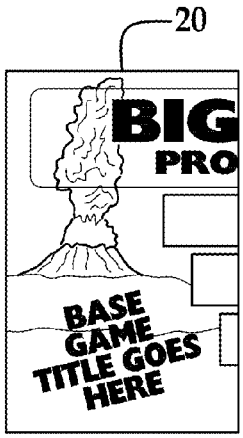
FIG. 8C is a third instance of the first screen shot of a top display on the gaming machine, according to an embodiment of the present invention.

During the primary game, the first display 20A will subtly animate, along with the incrementing of the four progressive tier values. For example in FIGS. 8A, 8B, and 8C, the volcano in the image will violently animate over time, ultimately causing lava to flow down from the top when the Big Reels Progressive bonus event is triggered. This in turn provides a transition animation going from the screen of the first display 20A to the top half of the giant reel that is displayed during the Big Reels Progressive bonus event.

This animation also "clues" players in to when the event could potentially trigger.

Figure 9:
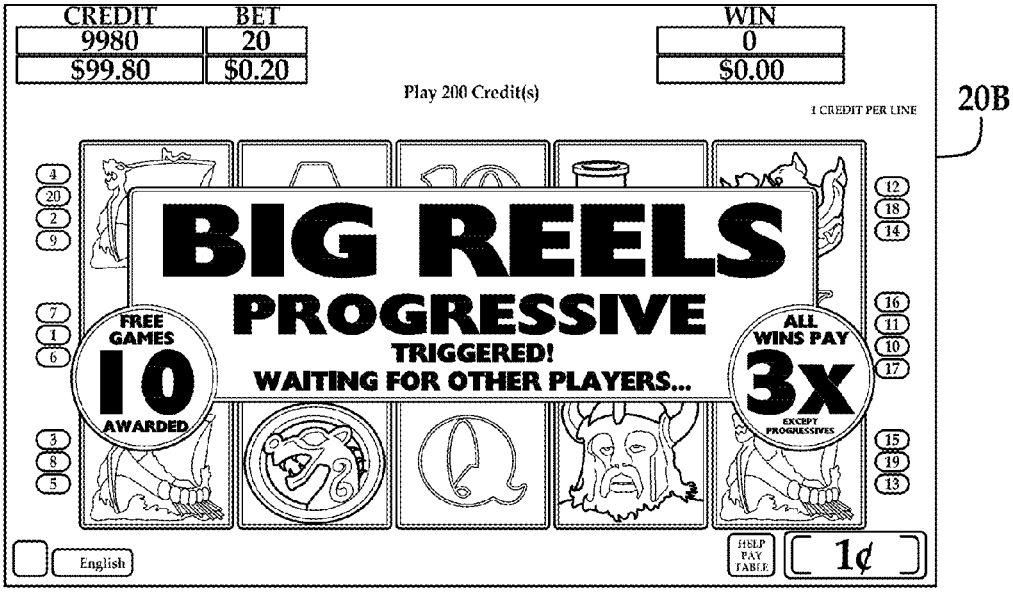
FIG. 9 is an exemplary trigger banner screen shot, according to an embodiment of the present invention.

With reference to FIG. 9, when the Big Reels Progressive bonus event is triggered an animated banner is displayed on the second display 20B to all players informing each of them the bonus has been triggered and what multiplier will be applied to each win (except progressives) during the bonus. In the illustrated embodiment, the animated banner is displayed for about 5 seconds (or until all gaming machines 14 are connected).

Then the lava from the first display 20A (described earlier) will flow to the bottom display, causing the remaining half of the screen to transition to the bottom half of the giant reel that is displayed during the Big Reels Progressive bonus event.

With reference to FIG. 11 for illustrative purposes only, the Big Reels Progressive bonus event will utilize a set of predefined symbols as the first three reels 72A, 72B, 72C. These symbols appear on the leftmost three gaming machines 14 in the four machine bank. With reference to FIG. 12, the reel symbols for the last player (the bonus reel player) are displayed. A sample payout schedule for the secondary game is shown in FIG. 13.

With reference to FIGS. 14 and 15 after the game transitions to the Big Reels Progressive bonus event, a triggering screen 94 is displayed to the triggering player (at left) and a non-triggering screen 96 is displayed to the non-triggering player.

With reference to FIG. 16 it should be noted that the reels 72 of the secondary game 70 do not necessarily start in the same starting position on all of the gaming machines 14.

Also, all pertinent bonusing information is shown to each player respectively, i.e., how many free spins they have and what their multiplier is for all winning combinations (except for progressive values).

SUMMARY EXEMPLARY OF GAME RULES

The following are sample game rules for the Big Reels Progressive bonus event.

Players qualify for the event by having played a bought game with extra bet enabled (forced) preceding the Big Reels Progressive bonus event trigger.

The event is randomly triggered from the jackpot controller 12.

Extra Bet is a predetermined amount, e.g., 15 credits, and adds a bonus multiplier of 1×-20× to all credit and progressive prizes won during the bonus event, depending on how fast the player plays.

When the Big Reels Progressive bonus event is triggered, ten spins are awarded to all players. Each of these spins are played out simultaneously on the "giant reels", where the rightmost player's machine is the bonus reel.

All eligible players share the same outcome (Linked Outcome) of the spins modified by their bonus multiplier.

The same progressive jackpot can be won more than once during the bonus event.

The trigger cycle may be small, e.g., between 30-60 games.

The game math may support 1 type of game configuration: a single line, 4 symbol version (three reels+a bonus reel).

The spin outcomes may be displayed on the top and bottom screens of each machine where 1 symbol outcome is displayed on each machine utilizing the payline lighting 64 in between the first and second displays 20A, 20B as the payline.

In this version of the game 2 or 3 symbols towards a pay on the first 3 machines shall cause the 3rd and/or 4th (bonus) reel to spin an extra few revolutions to increase excitement and anticipation for the players.

If the bank of gaming machines 14 is less than full, the players participating in the bank will utilize the entire bank of machines for the Big Reels Progressive bonus event. The unmanned banks become inactive for any players that want to walk up to the gaming machines 14 and want to play until the bonus event ends.

If a player walks up and deposits money into a gaming machine 14 that is currently in the Big Reels Progressive bonus event, a "Please Wait" banner is shown on the display screen. When the bonus event ends, the money deposited will then register on the machine and the new player can commence playing.

A credit award will be added to the player's remaining credits upon cash out for the multiplier value.

Figure 10:
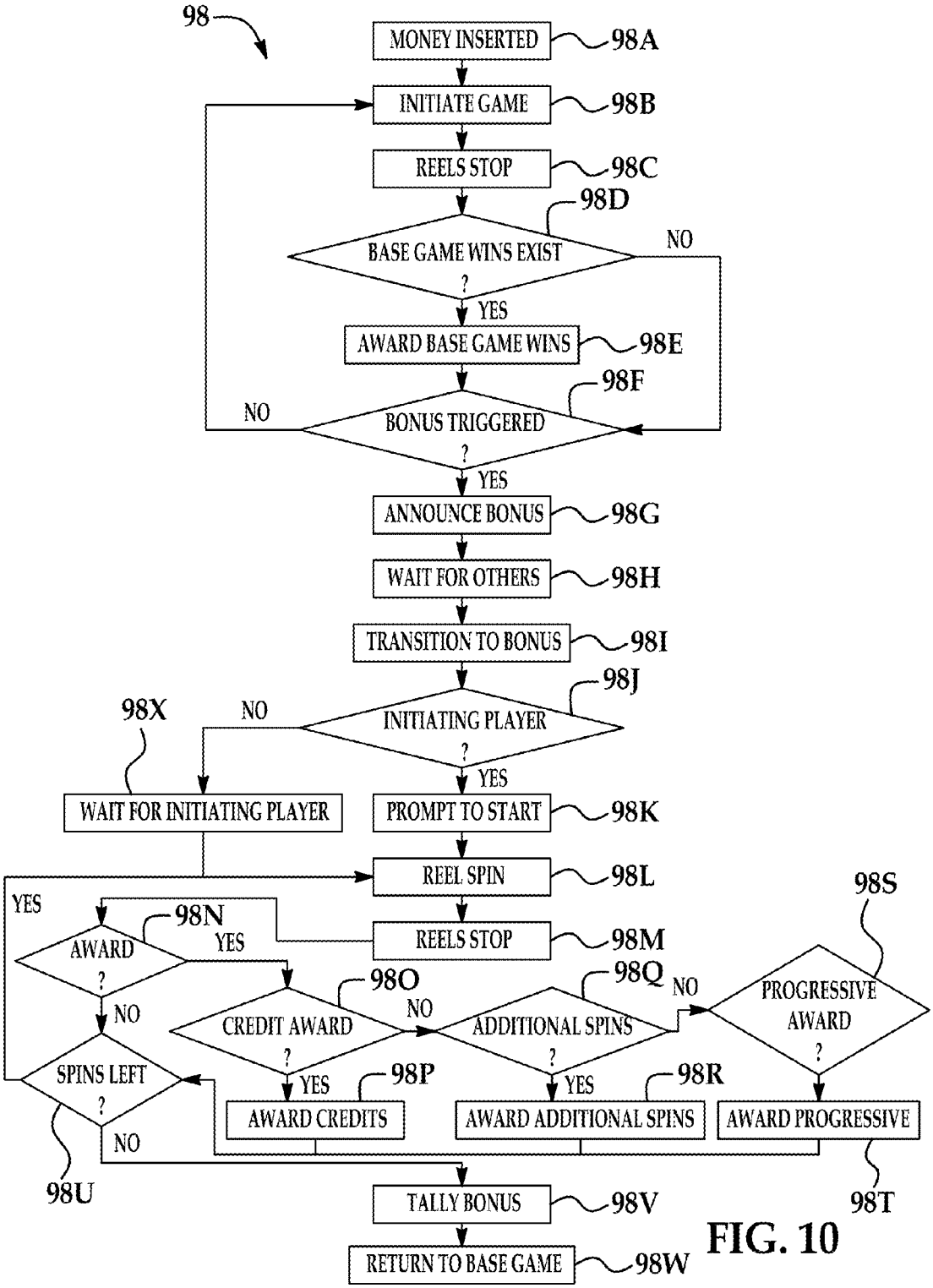
FIG. 10 is a flow diagram of a method for providing a bonus or secondary game to a plurality of players, according to an embodiment of the present invention.

With reference to FIG. 10, in one embodiment a method 98 provides primary and secondary games to a plurality of players using a plurality of linked gaming machines 14. The method 98 of FIG. 10 is for the master gaming machine 14, i.e., the gaming machine 14 which triggers the progressive game. In a first step 98A, money in the form of tokens, a ticket, coins or bills is inserted into one of the gaming machines 14. In a second step 98B, the primary game is initiated and in a third step 98C, the primary game is ended, i.e., reels are stopped. In a first decision block 98D if any wins exist in the primary (base) game, the method 98 proceeds to step 98E. Otherwise, the method 98 proceeds to a second decision block 98F. In the fourth step 98E, any wins in the base game are paid.

In the second decision block 98F, if the bonus is not triggered, then the method 98 returns to the second step 98B. If the bonus is triggered, then the method 98 proceeds to a fifth step 98G. In the fifth step 98G, the bonus game is announced to the players. In a sixth step 98H, the master gaming machine 14 waits for the other gaming machines 14. In a seventh step 98I, the gaming machines 14 are transitioned to the bonus game. If the gaming machine 14 is the initiating player (control block 98J), then the player is prompted to start the bonus game (step 98K), the reels are spun (98L), and the reels are stopped (98M). If the gaming machine 14 is not the initiating player, then the method 98 proceeds to step 98X.

In decision block 98N if the bonus game results in an award, i.e., a win, then the method 98 proceeds to decision block 98O.

Otherwise, the method proceeds to decision block 98U. In decision block 98U, the if there are spins left in the bonus game, then the method 98 returns to step 98L. Otherwise, the method 98 proceeds to step 98V.

In decision blocks 98O, 98Q, 98S, the method 98 establishes the nature or type of award to be awarded (credit, additional spins, or a progressive award) and responsively awards the established type of award (steps 98P, 98R, 98T).

In step 98V, the total bonus award is tallied and, in step 98W, the method 98 returns to the base game.

The present invention may be practiced other than as described in the above embodiments. For example, more than two displays 20 may be provided on each gaming machine 14. A Podium light associated with each additional display. Each podium light may act as a payline with respect to the secondary game. Other aspect and features of the present invention can be obtained from a study of the drawings, the disclosure, and the appended claims.

What is claimed is:

1. A method of providing primary and secondary games to players, including the steps of:

providing a plurality of linked gaming machines, each gaming machine including a display;

for each gaming machine:

allowing an associated player to make a wager on a primary game;

randomly selecting an outcome of the primary game;

determining if the outcome of the primary game is a winning outcome; and, awarding the associated player a primary award as a function of the outcome, the wager made by the player, and a predetermined paytable; and, determining if a triggering conditioning occurred in one of the primary games and initiating a secondary game, the secondary game being a video slot game including a plurality of video reels, the video reels forming a grid displayed across the displays of the gaming machines;

for the secondary game:

randomly selecting an outcome of the secondary game;

spinning the video reels and displaying a portion of the outcome of the secondary game on each video reel; and awarding one or more of the players a secondary award as a function of the outcome of the secondary game.

2. A method, as set forth in claim 1, wherein each video reel of the secondary game is displayed on the display of a respective one of the gaming machines.

3. A method, as set forth in claim 1, the secondary game being a progressive game.

4. A method, as set forth in claim 3, the outcome of the secondary game being one of a set amount and a progressive award.

5. A method, as set forth in claim 3, the progressive award being one of a plurality of progressive award levels.

6. A method, as set forth in claim 1, the video slot game of the secondary game having a single payline.

7. A method, as set forth in claim 1, the display of each gaming machine formed by first and second display devices, a first portion of each video reel being displayed on the first display device of the associated gaming machine and a second portion of each video reel being displayed on the second display device of the associated gaming machine.

8. A method, as set forth in claim 7, the video slot game of the secondary game having a payline formed by an area separating the first and second display devices.

9. A method, as set forth in claim 8, wherein the area separating the first and second display devices includes a lighting device.

10. A method, as set forth in claim 1, wherein the plurality of gaming machines are located side by side in a bank.

11. A method, as set forth in claim 10, wherein a predetermined number of the reels of the video slot game of the secondary game are standard reels and at least one of the reels is a bonus reel.

12. A method, as set forth in claim 11, the video reels forming a grid of cells, the outcome of the secondary game including a symbol from a set of predetermined symbols being associated with each cell.

13. A gaming system, comprising:

a plurality of linked gaming machines, each gaming machine including a display and a game controller, the controller for allowing an associated player to make a wager on a primary game, randomly selecting an outcome of the primary game, determining if the outcome of the primary game is a winning outcome, and awarding the associated player a primary award as a function of the outcome, the wager made by the player, and a predetermined paytable; and, a jackpot controller for determining if a triggering conditioning occurred in one of the primary games and initiating a secondary game, the secondary game being a video slot game including a plurality of video reels, the video reels forming a grid displayed across the displays of the gaming machines, the jackpot controller for randomly selecting an outcome of the secondary game, spinning the video reels and displaying a portion of the outcome of the secondary game on each video reel, and awarding one or more of the players a secondary award as a function of the outcome of the secondary game.

14. A gaming system, as set forth in claim 13, wherein each video reel of the secondary game is displayed on the display of a respective one of the gaming machines.

15. A gaming system, as set forth in claim 13, the secondary game being a progressive game.

16. A gaming system, as set forth in claim 14, the outcome of the secondary game being one of a set amount and a progressive award.

17. A gaming system, as set forth in claim 16, the progressive award being one of a plurality of progressive award levels.

18. A gaming system, as set forth in claim 13, the video slot game of the secondary game having a single payline.

19. A gaming system, as set forth in claim 13, the display of each gaming machine formed by first and second display devices, a first portion of each video reel being displayed on the first display device of the associated gaming machine and a second portion of each video reel being displayed on the second display device of the associated gaming machine.

20. A gaming system, as set forth in claim 19, the video slot game of the secondary game having a payline formed by an area separating the first and second display devices.

21. A gaming system, as set forth in claim 20, wherein the area separating the first and second display devices includes a lighting device.

22. A gaming system, as set forth in claim 13, wherein the plurality of gaming machines are located side by side in a bank.

23. A gaming system, as set forth in claim 22, wherein a predetermined number of the reels of the video slot game of the secondary game are standard reels and at least one of the reels is a bonus reel.

24. A gaming system, as set forth in claim 23, the video reels forming a grid of cells, the outcome of the secondary game including a symbol from a set of predetermined symbols being associated with each cell.

* * * * *